US007361071B1

(12) United States Patent
Lauren

(10) Patent No.: US 7,361,071 B1
(45) Date of Patent: Apr. 22, 2008

(54) ON-SITE-INFLATABLE WATER SKIS WITH AT LEAST ONE COOPERATING ON-SITE-INFLATABLE PADDLE

(76) Inventor: Givi Lauren, 104-40 Queens Blvd., Apt. 17J, Forrest Hills, NY (US) 11375

( * ) Notice: Subject to any disclaimer, the term of this patent is extended or adjusted under 35 U.S.C. 154(b) by 0 days.

(21) Appl. No.: 11/503,835

(22) Filed: Aug. 14, 2006

(51) Int. Cl.
*B63B 35/83* (2006.01)

(52) U.S. Cl. ..... 441/76

(58) Field of Classification Search ..... 441/65, 441/66, 68, 76, 77
See application file for complete search history.

(56) References Cited

U.S. PATENT DOCUMENTS

| | | | | |
|---|---|---|---|---|
| 3,750,203 | A * | 8/1973 | Ceccato | 441/76 |
| 3,758,898 | A * | 9/1973 | Dougherty | 441/77 |
| 3,835,494 | A | 9/1974 | Dougherty | 9/310 D |
| 3,952,353 | A * | 4/1976 | Word | 441/76 |
| 4,157,597 | A | 6/1979 | Trebnick | 9/310 D |
| 4,606,728 | A | 8/1986 | Simpson | 441/66 |
| 5,593,334 | A * | 1/1997 | Thayer | 441/77 |
| 6,129,600 | A | 10/2000 | Nordby | 440/101 |
| 6,855,024 | B2 | 2/2005 | Rothschild | 441/77 |
| 2003/0203686 | A1 | 10/2003 | Rothschild | 441/77 |

FOREIGN PATENT DOCUMENTS

DE 3127408 A1 * 1/1983

* cited by examiner

*Primary Examiner*—Lars A. Olson
(74) *Attorney, Agent, or Firm*—Bernard S. Hoffman

(57) ABSTRACT

On-site-inflatable water skis with at least one cooperating on-site-inflatable paddle for use by a user in water. The combination includes water skis and at least one paddle. The water skis are on-site inflatable to facilitate transport and reduce required storage space and are worn by the user. The at least one paddle is on-site inflatable to facilitate transport and reduce required storage space and is used by the user to paddle the water and propel the user wearing the water skis through the water.

35 Claims, 4 Drawing Sheets

ON-SITE-INFLATABLE WATER SKIS WITH AT LEAST ONE COOPERATING ON-SITE-INFLATABLE PADDLE

1. BACKGROUND OF THE INVENTION

A. Field of the Invention

The embodiments of the present invention relate to water skis, and more particularly, the embodiments of the present invention relate to on-site-inflatable water skis with at least one cooperating on-site-inflatable paddle.

B. Description of the Prior Art

Water skiing is a popular sport. Still, water skiing is associated with fast speeds and for that reason is not appealing to many individuals. Also, water skiing requires that the skier have sufficient strength to get up from a sitting position and be able to hold on to a rope and thereby be pulled behind a boat over the water surface. In addition, water skiing requires a boat having sufficient power to pull the skier over the water. Thus, in addition to requiring sophisticated equipment, the sport requires a particular type of athlete.

Since today's water skiers are propelled by boats and helicopters, the skiers have no independence. Moreover, the ability to walk on water has intrigued man for millennia.

Numerous innovations for water skis and related water devices have been provided in the prior art, which will be described below chronologically to show advancement in the art, and which are incorporated herein by reference thereto. Even though these innovations may be suitable for the specific individual purposes to which they address, they each differ in structure and/or operation and/or purpose from the embodiments of the present invention in that they do not teach on-site-inflatable water skis with at least one cooperating on-site-inflatable paddle, but rather teach devices that are bulky, not portable, and require special apparatus to transport them, i.e., they cannot be deflated and carried by the user and then inflated by the user on-site.

(1) U.S. Pat. No. 3,835,494 to Dougherty

U.S. Pat. No. 3,835,494 issued to Dougherty on Sep. 17, 1974 in class 9 and subclass 310 D teaches a water walking apparatus, including a pair of elongated pontoons by which a user is able to propel himself through the water with a walking motion. The pontoons have longitudinally extending tunnels with flippers therein and have ballast tanks with buoyancy adjusting valves. The pontoons are formed with pitch dampeners thereon for improved stability and may also be provided with inertia reducers and propelling fins or flippers to increase the speed and distance traveled with the expenditure of a given amount of energy.

(2) U.S. Pat. No. 4,157,597 to Trebnick

U.S. Pat. No. 4,157,597 issued to Trebnick on Jun. 12, 1979 in class 9 and subclass 310 D teaches operator propelled water skis, including a pair of elongated float-type ski members with suitable operator foot supports therein mounted in a thwart-type frame having outrigger floats attached thereto. A pair of ski pole floats are similarly positioned on the frame and are slidable relative thereto through movement of ski poles coupled to the floats to increase stability of the water skis to the operator and provide a way for propelling the skis. The ski members and ski pole floats have surfaces thereon increasing the resistance of movement of the floats and ski members in one direction of the skis and reduce resistance in the opposite direction of movement to aid in movement of the skis.

(3) U.S. Pat. No. 4,606,728 to Simpson

U.S. Pat. No. 4,606,728 issued to Simpson on Aug. 19, 1986 in class 441 and subclass 66 teaches a water ski aid for supporting a water skier, including an inflatable seat member. A pair of inflatable arms are used to secure the skier to the inflatable seat member. The free ends of the arms overlap the body of the skier when in a secure position in the seat member. The arms separate when the skier gains sufficient speed to overcome the drag of the inflatable seat member.

(4) U.S. Pat. No. 6,129,600 to Nordby

U.S. Pat. No. 6,129,600 issued to Nordby on Oct. 10, 2000 in class 440 and subclass 101 teaches a paddle floatation apparatus, including a unitary-inflatable sleeve fitting over a kayak or other shallow draft water craft paddle blade. When installed on a paddle blade, the entire paddle may be configured as an outrigger to assist the user in righting the kayak and reentering the cockpit from the water. The shape of the float when inflated is substantially triangular when viewed on end and includes numerous stabilizing surfaces engaging the water to resist unintentional movement in every direction.

(5) U.S. patent application Ser. No. 2003/0203686 to Rothschild

U.S. patent application Ser. No. 2003/0203686 published to Rothschild on Oct. 30, 2003 in class 441 and subclass 77 teaches skis allowing a human subject to walk by sliding of the legs back and forth in a motion similar to cross-country snow skis. In an embodiment, included are two skis having a foot-support for the subject to secure a foot on the upper surface of each ski, flaps secured to the bottom of each ski allowing the skis to frictionally interact with the water, so that when the subject pushes back on one of the skis, the subject is propelled forward across the water, and a frame connecting the two skis to each other allowing the skis to slide back and forth with respect to one another in a first direction being parallel to the length of the skis and also maintains the skis at a constant distance apart from each other in a second direction and at the same depth in the water in a third direction.

(6) U.S. Pat. No. 6,855,024 to Rothschild

U.S. Pat. No. 6,855,024 issued to Rothschild on Feb. 15, 2005 in class 441 and subclass 77 teaches skis allowing a human subject to walk by sliding of the legs back and forth in a motion similar to cross-country snow skis. In an embodiment, included are two skis having a foot-support for the subject to secure a foot on the upper surface of each ski, flaps secured to the bottom of each ski allowing the skis to frictionally interact with the water, so that when the subject pushes back on one of the skis, the subject is propelled forward across the water, and a frame connecting the two skis to each other allowing the skis to slide back and forth with respect to one another in a first direction being parallel to the length of the skis and also maintains the skis at a constant distance apart from each other in a second direction and at the same depth in the water in a third direction.

It is apparent that numerous innovations for water skis and related water devices have been provided in the prior art that are adapted to be used. Furthermore, even though these innovations may be suitable for the specific individual purposes to which they address, they would not be suitable for the purposes of the embodiments of the present invention as heretofore described, namely, on-site-inflatable water skis with at least one cooperating on-site-inflatable paddle.

Thus, there exists a need for skis and at least one cooperating paddle that are not bulky, portable, and do not require special apparatus to transport them, i.e., they can be deflated and carried by the user and then inflated by the user on-site.

2. SUMMARY OF THE INVENTION

Thus, an object of the embodiments of the present invention is to provide on-site-inflatable water skis with at least one cooperating on-site-inflatable paddle that avoids the disadvantages of the prior art.

Briefly stated, another object of the embodiments of the present invention is to provide on-site-inflatable water skis with at least one cooperating on-site-inflatable paddle for use by a user in water. The combination includes water skis and at least one paddle. The water skis are on-site inflatable to facilitate transport and reduce required storage space and are worn by the user. The at least one paddle is on-site inflatable to facilitate transport and reduce required storage space and is used by the user to paddle the water and propel the user wearing the water skis through the water.

The novel features considered characteristic of the embodiments of the present invention are set forth in the appended claims. The embodiments of the present invention themselves, however, both as to their construction and their method of operation, together with additional objects and advantages thereof, will be best understood from the following description of the specific embodiments when read and understood in connection with the accompanying drawing.

3. BRIEF DESCRIPTION OF THE DRAWING

The figures of the drawing are briefly described as follows.

Figure 3A:
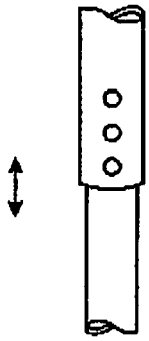
FIG. 3 is an enlarged diagrammatic perspective view of the at least one on-site-inflatable paddle of the on-site-inflatable water skis with at least one cooperating on-site-inflatable paddle of the embodiments of the present invention identified by ARROW 3 in FIG. 1.
Figure 3:
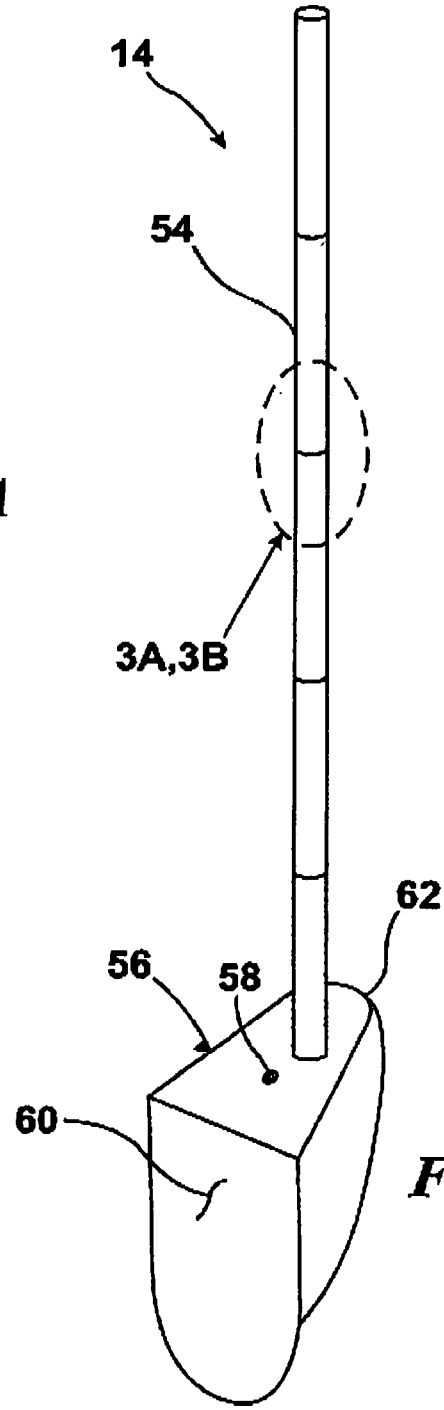
Figure 3B:
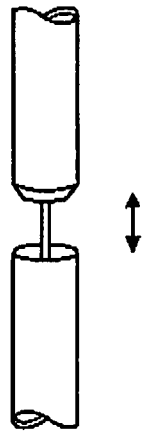

FIG. 3A is an enlarged diagrammatic perspective view of the area generally enclosed by the dotted curve identified by ARROW 3A in FIG. 3 of the telescopic version of the handle of the at least one paddle of the on-site-inflatable water skis with at least one cooperating on-site-inflatable paddle of the embodiments of the present invention; and FIG. 3B is an enlarged diagrammatic perspective view of the area generally enclosed by the dotted curve identified by ARROW 3B in FIG. 3 of the collapsible version of the handle of the at least one paddle of the on-site-inflatable water skis with at least one cooperating on-site-inflatable paddle of the embodiments of the present invention.

4. LIST OF REFERENCE NUMERALS UTILIZED IN THE DRAWING

A. General

10 on-site-inflatable water skis with at least one cooperating on-site-inflatable paddle of embodiments of present invention for use by user 11 in water having surface
11 user
12 water skis
14 at least one paddle

B. Water Skis 12

16 body of each ski of water skis 12
18 valve of body 16 of each ski of water skis 12
20 keel of body 16 of each ski of water skis 12
22 outer side of body 16 of each ski of water skis 12
24 inner side of body 16 of each ski of water skis 12
26 top of body 16 of each ski of water skis 12
28 bottom of body 16 of each ski of water skis 12
29 longitudinal center line of body 16 of each ski of water skis 12
30 bow of body 16 of each ski of water skis 12
32 stern of body 16 of each ski of water skis 12
34 boot of body 16 of each ski of water skis 12 for allowing user 11 to insert lower leg therein to control lateral rocking of body 16 of each ski of water skis 12 by user 11 and keeping body 16 of each ski of water skis 12 in upright position
36 upper portion of boot 34 in/on body 16 of each ski of water skis 12 for encasing ankle and calf of lower leg of user 11
38 shoe portion of boot 34 in/on body 16 of each ski of water skis 12 for encasing foot of lower leg of user 11
40 water line of body 16 of each ski of water skis 12
42 pitch dampeners of body 16 of each ski of water skis 12
44 front deck of pitch dampeners 42 of body 16 of each ski of water skis 12
46 rear deck of pitch dampeners 42 of body 16 of each ski of water skis 12
48 bottoms of front deck 44 of pitch dampeners 42 of body 16 of each ski of water skis 12 and rear deck 46 of pitch dampeners 42 of body 16 of each ski of water skis 12
49 first cord for resisting natural tendency for water skis 12 to drift apart during use
50 second cord for resisting natural tendency for water skis 12 to drift apart during use
52 third cord for resisting natural tendency for water skis 12 to drift apart during use and for serving as stirrups aiding user 11 in mounting and dismounting

C. At Least One Paddle 14

54 handle of each paddle of at least one paddle 14 for engaging by hands of user 11
56 head of each paddle of at least one paddle 14 for engaging water to propel user 11 paddling through water
58 valve of head 56 of each paddle of at least one paddle 14

60 rear surface of head 56 of each paddle of at least one paddle 14 for facilitating rearward pushing of water when each paddle of at least one paddle 14 is paddled through water by user 11

62 front surface of head 56 of each paddle of at least one paddle 14

5. DETAILED DESCRIPTION OF THE PREFERRED EMBODIMENTS

A. General

Figure 1:
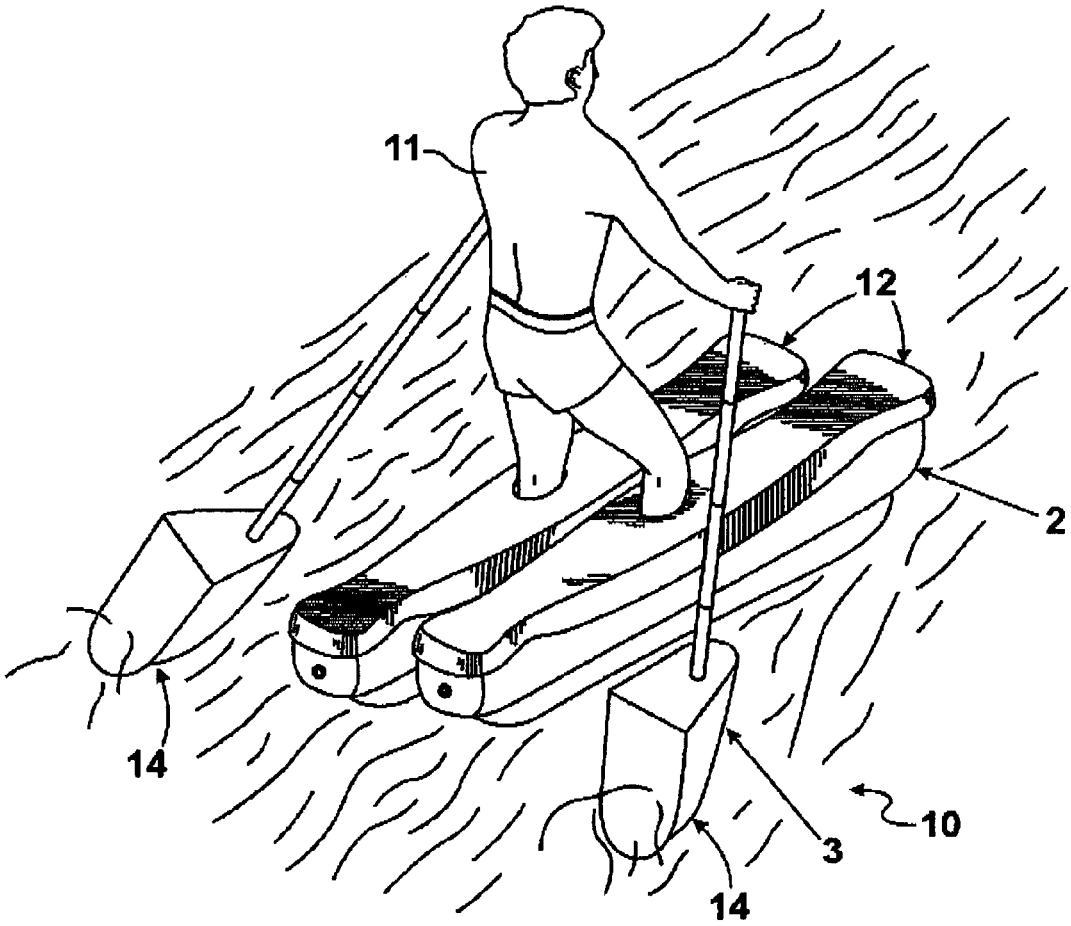
FIG. 1 is a diagrammatic perspective view of the on-site-inflatable water skis with at least one cooperating on-site-inflatable paddle of the embodiments of the present invention.

Referring now to the figures, in which like numerals indicate like parts, and particularly to FIG. 1, which is a diagrammatic perspective view of the on-site-inflatable water skis with at least one cooperating on-site-inflatable paddle of the embodiments of the present invention, the on-site-inflatable water skis with at least one cooperating on-site-inflatable paddle of the embodiments of the present invention is shown generally at 10 for use by a user 11 in water having a surface.

The on-site-inflatable water skis with at least one cooperating on-site-inflatable paddle 10 comprises water skis 12 and at least one paddle 14. The water skis 12 are on-site inflatable to facilitate transport and reduce required storage space and are for wearing by the user 11. The at least one paddle 14 is one or two paddles and is on-site inflatable to facilitate transport and reduce required storage space and is for use by the user 11 to engage the water and propel the user 11 wearing the water skis 10 through the water.

Both the water skis 12 and the at least one paddle 14 are inflatable by helium, which is much lighter than, and is more buoyant than, air.

B. The Water Skis 12

Since the water skis 12 are mirror images of each other, only on water ski 12 will be discussed.

Figure 2:
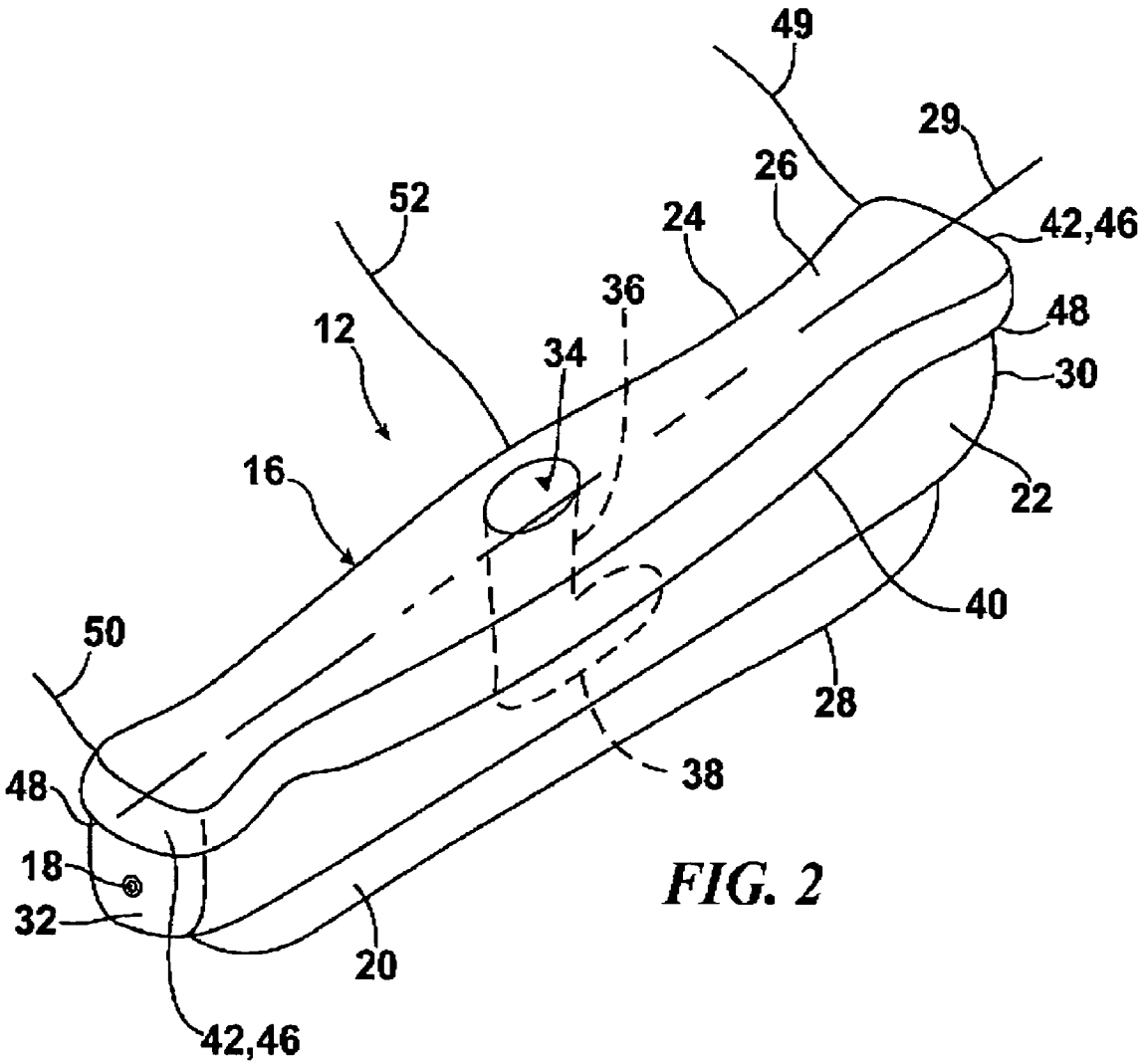
FIG. 2 is an enlarged diagrammatic perspective view of an on-site-inflatable water ski of the on-site-inflatable water skis with at least one cooperating on-site-inflatable paddle of the embodiments of the present invention identified by ARROW 2 in FIG. 1.

The configuration of a water ski 12 can best be seen in FIG. 2, which is an enlarged diagrammatic perspective view of an on-site-inflatable water skis of the on-site-inflatable water skis with a cooperating on-site-inflatable paddle of the embodiments of the present invention identified by ARROW 2 in FIG. 1, and as such, will be discussed with reference thereto.

The water ski 12 is elongated, and has a generally rectangular cross section, a height, and a width less than the height so as to allow the water skis 12 to be positioned in a close juxtaposed relationship to each other so as not to require a user 11 to assume an exaggerated straddle-legged position and so as to resist lateral drifting.

The water ski 12 comprises a body 16. The body 16 is hollow, and made of an inflatable material and has a valve 18 so as to allow the water ski 12 to be on-site inflatable.

The body 16 further has a keel 20, an outer side 22, an inner side 24, a top 26, a bottom 28, and a longitudinal center line 29. The keel 20 of the body 16 is optional, reinforces the body 16, and is made of a friction-reducing material for facilitating movement through the water. See FIG. 2A for a body 16 without a keel 20.

The outer side 22 of the body 16 and the inner side 24 of the body 16 are longitudinally extending arcuate so as to form arcuate shapes that are streamline and have midship portions 24 that are laterally bulging and tapering fore and aft into a bow 30 that is substantially pointed and a stern 32 that is substantially pointed, respectively.

It should be understood however, that the arcuate shapes of the outer side 22 of the body 16 and the inner side 24 of the body 16 need not be symmetrical. For example, the inner side 24 of the body 16 may be formed with less of a curve than the outer side 22 of the body 16 so as to allow the water skis 12 to be positioned closer together for allowing the user 11 to stand in a more natural position.

The body 16 further has a boot 34 for allowing the user 11 to insert the lower leg therein to control lateral rocking of the body 16 by the user 11 and keep the body 16 in an upright position. The boot 34 of the body 16 is located substantially centrally intermediate the bow 30 of the body 16 and the stern 32 of the body 16 and is located at different elevations relative to the body 16 depending upon skill of the user.

The boot 34 in the body 16 is laterally offset adjacent to the inner side 24 of the body 16 for eliminating the user 11 from having to assume an exaggerated straddle-legged position.

The boot 34 in the body 16 has an upper portion 36 that is substantially cylindrical, and a shoe portion 38. The upper portion 36 of the boot 34 is for encasing the ankle and the calf of the lower leg of the user 11, and the shoe portion 38 of the boot 34 is for encasing the foot of the lower leg of the user 11.

Figure 2A:
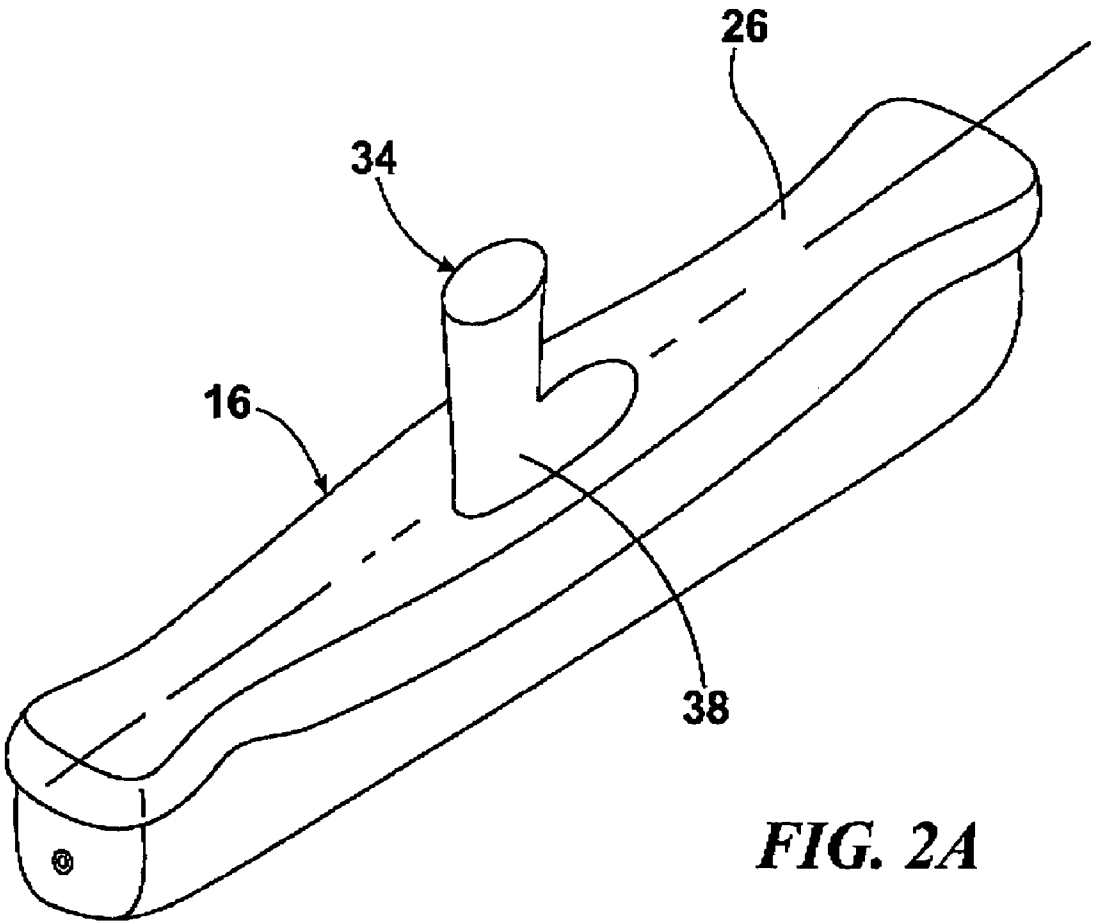
FIG. 2A is an enlarged diagrammatic perspective view of an alternate embodiment of the on-site-inflatable water ski of the on-site-inflatable water skis with at least one cooperating on-site-inflatable paddle of the embodiments of the present invention.

For beginners, the shoe portion 38 of the boot 34 is located adjacent the bottom 28 of the body 16, and the upper portion 36 of the boot 34 extends upwardly through the body 16 to the top 26 of the body 16 so as to afford stability due to a lower center of gravity. But for more experienced skiers, as shown in FIG. 2A, which is an enlarged diagrammatic perspective view of an alternate embodiment of the on-site-inflatable water ski of the on-site-inflatable water skis with at least one cooperating on-site-inflatable paddle of the embodiments of the present invention, the shoe portion 38 of the boot 34 is located adjacent the top 26 of the body 16 so as to afford less stability due to a higher center of gravity and therefore require better balance, coordination, and be more challenging as a sport.

Effects on the user 11 of pitching movements, i.e., rocking in a plane laying through the longitudinal center line 29 of the body 16, are held to a minimum by the ball of the foot of the user 11 being located substantially intermediate the bow 30 of the body 16 and the stern 32 of the body 16.

The body 16 further has a water line 40 and pitch dampeners 42. The pitch dampeners 42 of the body 16 are disposed on the bow 30 of the body 16 and the stern 32 of the body 16 and further insure stability of the body 16.

The pitch dampeners 42 of the body 16 include a front deck 44 that is a forwardly extending cantilever located at the bow 30 of the body 16, and a rear deck 46 that is a rearwardly extending cantilever located at the stern 32 of the body 16. The front deck 44 of the pitch dampeners 42 and the rear deck 46 of the pitch dampeners 42 are flush with the top 26 of the body 16 and have bottoms 48 and thicknesses placing the bottoms 48 thereof just above the water line 40 of the body 16. Thus, the front deck 44 of the body 16 resists attempts of the bow 30 of the body 16 to dip below the surface of the water and the rear deck 46 of the body 16 resists attempts of the stern 32 of the body 16 to dip below the surface of the water.

The water ski 12 further comprises a first cord 49, a second cord 50, and a third cord 52 for resisting a natural tendency for the water skis 12 to drift apart during use. The first cord 49 is connected between the bows 30 of the bodies 16, respectively. The second cord 50 is connected between the sterns 32 of the bodies 16, respectively. The third cord 52 is interconnected between the midship portions 24 of the bodies 16, respectively, and is for further serving as stirrups aiding the user 11 in mounting and dismounting.

C. The At Least One Paddle 14

Since the at least one paddle 14 are identical to each other, only one paddle 14 will be discussed.

The configuration of the paddle 14 can best be seen in FIG. 3, which is an enlarged diagrammatic perspective view of the at least one on-site-inflatable paddle of the on-site-inflatable water skis with at least one cooperating on-site-inflatable paddle of the embodiments of the present invention identified by ARROW 3 in FIG. 1, and as such, will be discussed with reference thereto.

The paddle 14 comprises a handle 54 and a head 56. The head 56 of the paddle 14 extends from the handle 54 of the paddle 14.

The handle 54 of the paddle 14 is for engaging by the hands of the user 11, and is slender, elongated, and as shown in FIG. 3A, which is an enlarged diagrammatic perspective view of the area generally enclosed by the dotted curve identified by ARROW 3A in FIG. 3 of the telescopic version of the handle of the at least one paddle of the on-site-inflatable water skis with at least one cooperating on-site-inflatable paddle of the embodiments of the present invention, is telescopic to facilitate transport, reduce required storage space, and is height adjustable to adjust for height of the user. In the alternative, as shown in FIG. 3B, which is an enlarged diagrammatic perspective view of the area generally enclosed by the dotted curve identified by ARROW 3B in FIG. 3 of the collapsible version of the handle of the at least one paddle of the on-site-inflatable water skis with at least one cooperating on-site-inflatable paddle of the embodiments of the present invention, the handle 54 of the paddle 54 is collapsible to facilitate transport, reduce required storage space, and is height adjustable to adjust for height of the user.

The head 56 of the paddle 14 is downwardly tapering for facilitating insertion into the water, bulbous, hollow, is made of an inflatable material, has a valve 58 so as to allow the head 56 of the paddle 14 to be on-site inflatable, and is for engaging the water to propel the user 11 paddling through the water.

The head 56 of the paddle 14 has a rear surface 60. The rear surface 60 of the head 56 of the paddle 14 is rearwardly facing, is flat for facilitating rearward pushing of the water when the paddle 14 is paddled through the water by the user 11, and is downwardly extending past the head 56 of the paddle 14 for facilitating insertion of the head 56 of the paddle 14 into the water.

The head 56 of the paddle 14 has a front surface 62. The front surface 62 of the head 56 of the paddle 14 is forwardly facing and arcuate and diverges to the rear surface 60 of the head 56 of the paddle 14 to reduce drag.

D. CONCLUSIONS

It will be understood that each of the elements described above, or two or more together, may also find a useful application in other types of constructions differing from the types described above.

While the embodiments of the present invention have been illustrated and described as embodied in an on-site-inflatable water skis with at least one cooperating on-site-inflatable paddle, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt it for various applications without omitting features that from the standpoint of prior art fairly constitute characteristics of the generic or specific aspects of the embodiments of the present invention.

The invention claimed is:

1. On-site-inflatable water skis with at least one cooperating on-site-inflatable paddle for use by a user in water having a surface, comprising:
- a) water skis; and
- b) at least one paddle;
- wherein said water skis are on-site inflatable to facilitate transport and reduce required storage space;
- wherein said water skis are for wearing by the user;
- wherein sad at least one paddle is on-site inflatable to facilitate transport and reduce required storage space;
- wherein said at least one paddle is for use by the user to paddle the water and propel the user wearing said water skis through the water;
- wherein each water ski comprises a body;
- wherein said body is hollow;
- wherein said body is made of an inflatable material;
- wherein said body has an outer side;
- wherein said body has an inner side;
- wherein said outer side of said body and said inner side of said body are longitudinally extending arcuate so as to form arcuate shapes that are streamline and have midship portions that are laterally bulging and tapering fore and aft into a bow that is substantially pointed and a stern that is substantially pointed, respectively;
- wherein said body has pitch dampeners; and
- wherein said pitch dampeners of said body are disposed on said bow of said body and said stern of said body and insure stability of said body.

2. The combination of claim 1, wherein said water skis are mirror images of each other.

3. The combination of claim 1, wherein each water ski is elongated; and wherein each water ski has a generally rectangular cross section.

4. The combination of claim 1, wherein each water ski has a height;
- wherein each water ski has a width; and
- wherein said width of each water ski is less than said height of an associated water ski so as to allow said water skis to be positioned in a close juxtaposed relationship to each other so as not to require the user to assume an exaggerated straddle-legged position and so as to resist lateral drifting.

5. The combination of claim 1, wherein said body has a valve so as to allow each water ski to be on-site inflatable.

6. The combination of claim 1, wherein said body has a keel;
- wherein said keel of said body reinforces said body; and
- wherein said keel of said body is made of a friction-reducing material for facilitating movement through the water.

7. The combination of claim 1, wherein said arcuate shapes of said outer side of said body and said inner side of said body are symmetrical to each other.

8. The combination of claim 1, wherein said arcuate shapes of said outer side of said body and said inner side of said body are not symmetrical to each other.

9. The combination of claim 8 wherein said inner side of said body is formed with less of a curve than said outer side of said body so as to allow said water skis to be positioned closer together for allowing the user to stand in a more natural position.

10. The combination of claim 1, wherein said body has a boot therein for allowing the user to insert a lower leg therein to control lateral rocking of said body by the user and keep the body in an upright position.

11. The combination of claim 10 wherein said boot in said body is located substantially centrally intermediate said bow of said body and said stern of said body.

12. The combination of claim 10 wherein said boot in said body is laterally offset adjacent to said inner side of said body for eliminating the user from having to assume an exaggerated straddle-legged position.

13. The combination of claim 10 wherein said body has a top;

wherein said boot in said body has an upper portion;

wherein said upper portion of said boot extends upwardly through said body to said top of said body so as to afford stability due to a lower center of gravity; and wherein said upper portion of said boot is for encasing the ankle and the calf of the lower leg of the user.

14. The combination of claim 13 wherein said upper portion of said boot is substantially cylindrical.

15. The combination of claim 10 wherein said boot in said body has a shoe portion;

wherein said body has a bottom;

wherein said shoe portion of said boot is located adjacent said bottom of said body; and wherein said shoe portion of said boot is for encasing the foot of the lower leg of the user.

16. The combination of claim 1, wherein said pitch dampeners of said body include a front deck;

wherein said front deck of said pitch dampeners is located at said bow of said body;

wherein said pitch dampeners of said body include a rear deck; and wherein said rear deck of said pitch dampeners is located at said stern of said body.

17. The combination of claim 16 wherein said front deck of said pitch dampeners is a forwardly extending cantilever; and wherein said rear deck of said pitch dampeners is a rearwardly extending cantilever.

18. The combination of claim 16 wherein said body has a top;

wherein said front deck of said pitch dampeners is flush with said top of said body; and wherein said rear deck of said pitch dampeners is flush with said top of said body.

19. The combination of claim 16 wherein said body has a water line;

wherein said front deck of said pitch dampeners has a bottom;

wherein said front deck of said pitch dampeners has a thickness;

wherein said rear deck of said pitch dampeners has a bottom;

wherein said rear deck of said pitch dampeners has a thickness;

wherein said thickness of said front deck of said pitch dampener places said bottom thereof just above said water line of said body for resisting attempts of said bow of said body to dip below the surface of the water; and wherein said thickness of said rear deck of said pitch dampener places said bottom thereof just above said water line of said body for resisting attempts of said stern of said body to dip below the surface of the water.

20. The combination of claim 1, further comprising a first cord, a second cord, and a third cord for resisting a natural tendency for said water skis to drift apart during use.

21. The combination of claim 20 wherein said first cord is connected between said bows of said bodies of said water skis;

wherein said second cord is connected between said sterns of said bodies of said water skis;

wherein said third cord is interconnected between said midship portions of said bodies of said water skis; and wherein said third cord is for further serving as stirrups aiding the user in mounting and dismounting.

22. The combination of claim 1, wherein each paddle comprises a handle;

wherein said each paddle comprises a head; and wherein said head of said each paddle extends from said handle of an associated paddle.

23. The combination of claim 22 wherein said handle of said each paddle is for engaging by the hands of the user;

wherein said handle of each said paddle is slender; and wherein said handle of said each paddle is elongated.

24. The combination of claim 22 wherein said handle of said each paddle is telescopic to facilitate transport, reduce required storage space, and be height adjustable to adjust for height of the user.

25. The combination of claim 22 wherein said handle of said each paddle is collapsible to facilitate transport, reduce required storage space, and be height adjustable to adjust for height of the user.

26. The combination of claim 22 wherein said head of said each paddle is downwardly tapering for facilitating insertion into the water;

wherein said head of each said paddle is bulbous;

wherein said head of said each paddle is hollow;

wherein said head of said each paddle is made of an inflatable material; and wherein said head of said each paddle is for engaging the water to propel the user paddling through the water.

27. The combination of claim 22 wherein said head of said each paddle has a valve so as to allow said head of said each paddle to be on-site inflatable.

28. The combination of claim 22 wherein said head of said each paddle has a rear surface;

wherein said rear surface of said head of said each paddle is rearwardly facing;

wherein said rear surface of said head of said each paddle is flat for facilitating rearward pushing of the water when said each paddle is paddled through the water by the user; and wherein said rear surface of said head of said each paddle is downwardly extending past said head of an associated paddle for facilitating insertion of said head of said associated paddle into the water.

29. The combination of claim 22 wherein said head of said each paddle has a front surface; and wherein said front surface of said head of said each paddle is forwardly facing and arcuate and diverges to said rear surface of said head of an associated paddle to reduce drag.

30. The combination of claim 1, wherein said body has a boot thereon for allowing the user to insert a lower leg therein to control lateral rocking of said body by the user and keeping the body in an upright position.

31. The combination of claim 30 wherein said boot on said body has a shoe portion;

wherein said body has a top;

wherein said shoe portion of said boot is located adjacent said top of said body; and wherein said shoe portion of said boot is for encasing the foot of the lower leg of the user.

32. The combination of claim 30 wherein said boot on said body is located substantially centrally intermediate said bow of said body and said stern of said body.

33. The combination of claim 30 wherein said boot on said body is laterally offset adjacent to said inner side of said body for eliminating the user from having to assume an exaggerated straddle-legged position.

34. The combination of claim 31 wherein said boot on said body has an upper portion;

wherein said upper portion of said boot extends upwardly from said shoe portion of said boot of said body; and wherein said upper portion of said boot is for encasing the ankle and the calf of the lower leg of the user.

35. The combination of claim 34 wherein said upper portion of said boot is substantially cylindrical.

* * * * *